United States Patent [19]

Crawford

[11] 4,214,741

[45] Jul. 29, 1980

[54] NEEDLE PICKUP DEVICE

[75] Inventor: Douglas J. Crawford, Waterford, N.Y.

[73] Assignee: Cluett, Peabody & Co., Inc., New York, N.Y.

[21] Appl. No.: 44,986

[22] Filed: Jun. 4, 1979

Related U.S. Application Data

[63] Continuation of Ser. No. 835,781, Sep. 22, 1977.

[51] Int. Cl.[3] ..... B65H 3/22

[52] U.S. Cl. ..... 271/18.3

[58] Field of Search ..... 271/18.3

[56] References Cited

U.S. PATENT DOCUMENTS

| | | | |
|---|---|---|---|
| 3,981,495 | 9/1976 | Bijttebier | 271/18.3 |
| 4,042,271 | 8/1977 | Vinciguerra | 271/18.3 |

*Primary Examiner*—Richard A. Schacher

[57] ABSTRACT

A unique pickup device for single or multiple fabric or sheet layer materials incorporating a plurality of parallel needles which when simultaneously actuated pierce one or more layers to cause pickup, and after transport, stripping means for removal therefrom.

2 Claims, 12 Drawing Figures

NEEDLE PICKUP DEVICE

This is a continuation of application Ser. No. 835,781, filed Sept. 22, 1977.

BACKGROUND OF THE INVENTION

Various needle pickup devices are known which employ one or more needles which can be actuated to pierce single or multiple layers of fabric or other sheet material, thereby effecting pickup engagement. One form of such device has been disclosed in U.S. Pat. No. 3,601,390 which teaches the use of a plurality of needles which are respectively mounted in stationary and movable portions of a pickup head and which can spatially engage a fabric layer to cause the fabric to adhere to the head. Another generally similar mechanism is shown in U.S. Pat. No. 3,583,698, each of the foregoing representing developments of the present assignee.

The present invention concerns an improvement of previously developed techniques in that the disclosed device is able, with a great degree of precision, (a) to hold apparel parts before and during the pickup step, (b) to maintain such parts in a predetermined relationship to the pickup device while transporting same to another location, and (c) to deposit such parts precisely in a new location during disengagement of the needles from the pickup device. Also, the needle configuration in the disclosed arrangement is such that the new pickup device will not disfigure fabric by its needle-piercing action or by withdrawal of the needles from the fabric.

SUMMARY OF THE INVENTION

In accordance with the present invention, a device is disclosed which is attached to pick up and release a layer of sheet material, i.e. a fabric part, from a loading platform. The pickup device comprises a frame having a vertical and a horizontal axis, and a plurality of spaced needles secured to the frame to project downwardly from an under surface of the frame parallel to the vertical axis. A combination clamping and stripper plate is arranged horizontally beneath the needles and the frame. Means are provided for moving the clamping and stripper plate toward the sheet material located on the loading platform to initially clamp the sheet material against the loading platform. Thereafter, the needles are extended through apertures in the stripper plate and through the sheet material, the movement of the needles through the material being limited by stop means intermediate the plate and frame. Thus pierced, the sheet material will adhere to the needles for transport to an alternate location. Upon arrival at the alternate location, the clamping and stripper plate will be actuated to move the stripper plate away from the frame thus withdrawing the needles in a stripping action from the sheet material in order to deposit the sheet material at the alternate location.

BRIEF DESCRIPTION OF THE DRAWINGS

FIG. 1(*b*) illustrates the pickup device of the present invention as it would initially appear in relation to the shutter carrying a part deposited thereon by the pickup device of FIG. 1(*a*);

FIG. 1(*c*) indicates an alternate position of the pickup device of the present invention having picked up from the position shown in FIG. 1(*b*), preparing to deposit a part after transporting same to an alternate location;

DESCRIPTION OF A PARTICULAR EMBODIMENT

Figure 1A:
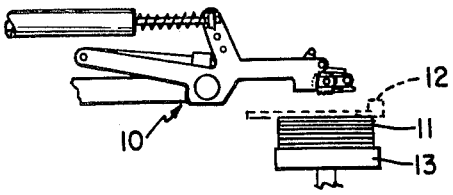
FIG. 1(*a*) illustrates the use of a fabric picker picking from a stack of fabric parts and depositing same upon a shutter for transport to the pickup device of the present invention.
Figure 1B:
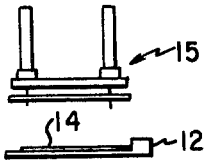
Figure 1C:
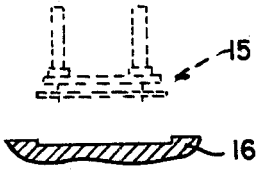
Figure 2:
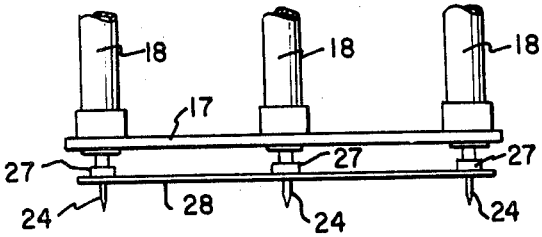
FIG. 2 is a side view of the pickup device of the present invention in its at-rest or non-actuated position.

Referring now to the drawing and initially to FIGS. 1(*a*), 1(*b*) and 1(*c*), a possible pick up sequence involving the pickup device of the present invention in conjunction with a previously developed pickup device has been illustrated. In FIG. 1(*a*), a prior pickup device 10, which has been described in U.S. Pat. No. 3,940,125, is shown about to pick the uppermost fabric part 14 from a stack of parts 11 arranged upon platform 13. Shown in dotted outline is a shutter 12 which assists the picker 10 in separating the picked fabric layer from the stack while causing the fabric layer to be deposited upon the shutter 12. FIG. 1(*b*) illustrates an alternate position of the shutter 12 wherein the part 14 has been brought beneath the pickup device 15 of the present invention. As will be more fully described, the pickup device 15 can be moved into position immediately above the fabric part 14 to cause adherence of the part 14 to the pickup device 15. FIG. 1(*c*) shows the pickup device 15 in dotted outline having been moved to an alternate position above a station 16 upon which the fabric layer 14 is to be deposited. The foregoing represents a typical picking and transporting sequence; however, it will be understood that variations of such pick up and transportation sequence are possible. For example, a series of pickup devices 15 may be arranged to pick up the fabric parts from various loading platforms or shutters and may be caused to deposit different parts in registry, for example upon a receiving station 16 which delivers them to be hemmed or sewn together.

Figure 6:
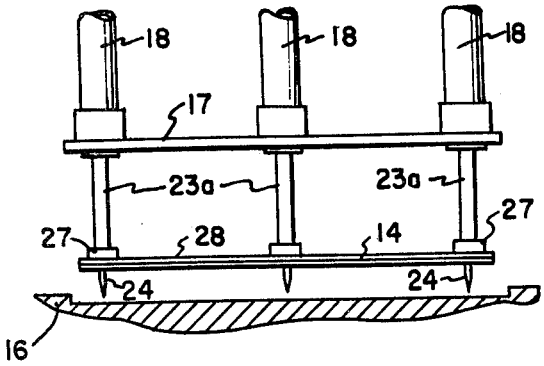
FIG. 6 illustrates the pickup device in position immediately prior to deposition of the part.
Figure 7:
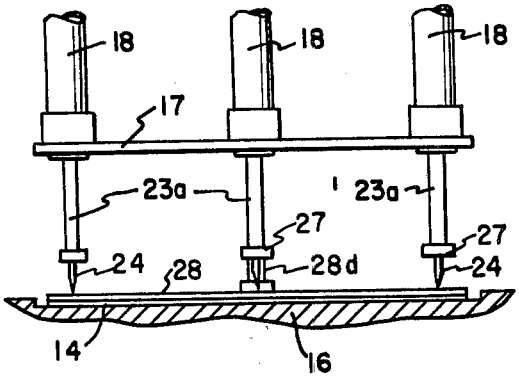
FIG. 7 illustrates the pickup device of FIG. 2 with the stripper plate having been actuated to strip the fabric part from the needles.
Figure 8:
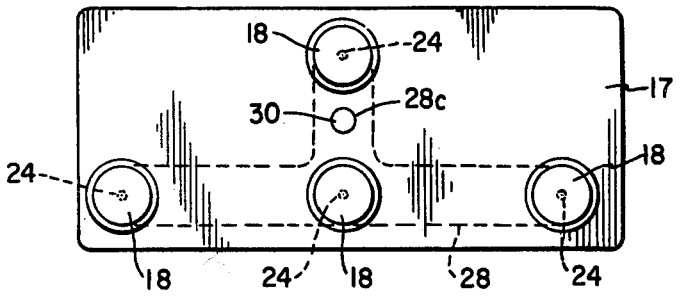
FIG. 8 is a top view of the pickup device of FIG. 2.
Figure 9:
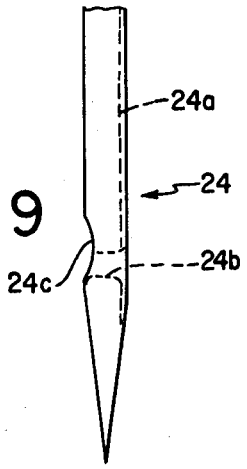
FIG. 9 is a partial side view of a sewing needle which can be used in the pickup device of FIG. 2.
Figure 10:
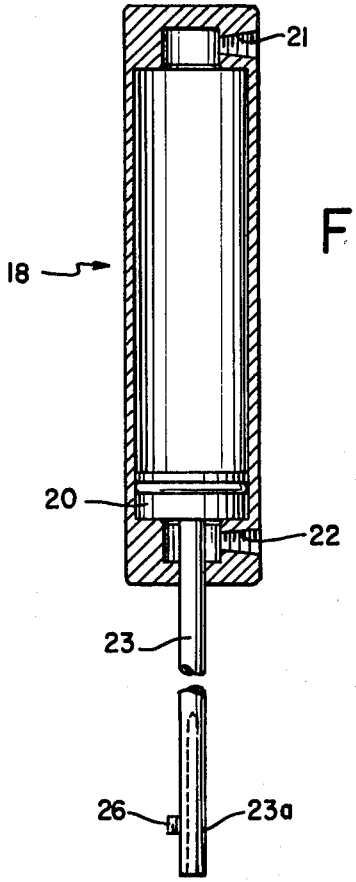
FIG. 10 is a diagrammatic illustration partially in cross section of a needle holder and actuator.

Referring now to the more detailed construction of the pickup device 15 as disclosed in FIGS. 2–10, it will be seen that the device incorporates a horizontal mounting frame 17 to which are attached a plurality of air actuators 18. As seen in FIG. 10, each of the air actuators consists of a hollow cylinder 19 containing a piston 20 reciprocally movable within the cylinder toward the frame 17 by admitting air at the top of the cylinder through port 21. Air pressure is maintained at the bottom of cylinder 19, through port 22, to return the piston 20 to its top position whenever pressure ceases to be applied through port 21. Piston 20 is connected to the arm 23 which extends through the frame 17 and comprises beneath the frame the hollow needle holder 23*a*. The shank of a needle 24 is retained within the needle holder 23*a* by set screw 26. Affixed to the lower end of the needle holder 23*a* is a flat washer-like stop 27, whose function is to abut against the upper surface of a combination clamping and stripper plate 28 horizontally arranged beneath frame 17, thus limiting movement of the needles downwardly through apertures provided in the plate 28 and through the part 14 when the needle holders 23*a* are moved downwardly by respective air actuators 18. FIG. 8 illustrates the relative positions of the needle actuating cylinders and the stripper plate. The needles and their actuating cylinders are arranged in a triangular manner with elongated portions of the stripper plate 28 extending beneath each of the needles. The stripper plate 28 is actuated toward and away from the frame 17 by means of an air actuated cylinder 18 mounted to the frame 17. An actuating rod 28*d* interconnects the plate air actuated cylinder 18 and the plate 28 to effect downward and upward movement of the plate 28 upon actuation of the air cylinder. A guide pin 30 is rigidly secured to the frame 17 and depends therefrom through section 28*c* of the stripper plate.

Figure 3:
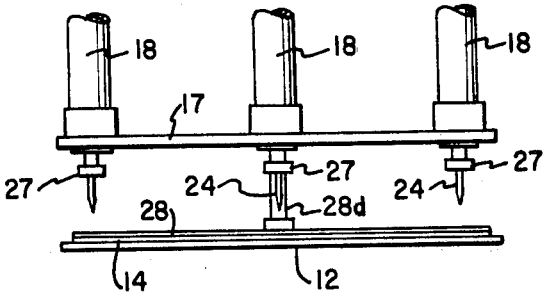
FIG. 3 is a side view of the pickup device of FIG. 2 with the combination clamping and stripper plate having been moved to press a fabric part against a loading platform supporting such part.
Figure 4:
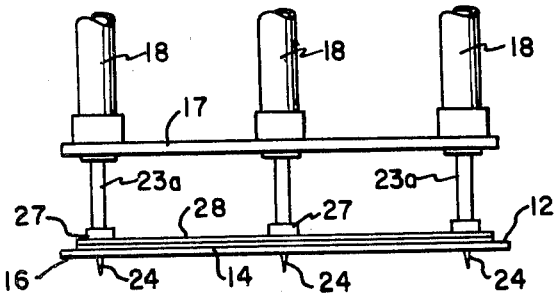
FIG. 4 illustrates the pickup device of FIG. 2 wherein the needles of the device have been actuated to extend through the clamping and stripper plate and through the fabric part and through the shutter loading platform.
Figure 5:
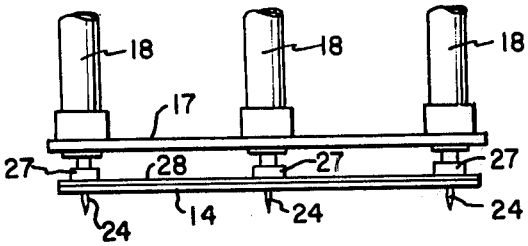
FIG. 5 illustrates the pickup device in its transport mode position.

FIG. 3 shows the position of the clamping and stripper plate after it has been actuated downwardly against a fabric part 14 to hold the part 14 against the shutter 12. This is the initial phase of the picking operation and causes the part to be securely held prior to piercing movement of the needles through the part. FIG. 4 illustrates the relative position of the parts of the pickup device after actuation of the needles through the clamping and stripper plate 28 and through the part 14. it will be observed that the ends of the needles also extend slightly through the shutter 12 which has been provided with slots for this purpose. After pick up, pressure is released above the respective pistons 20, and the pressure below will cause retraction of the needles with part 14 and stripper plate with part 14 to the position shown in FIG. 5, which is the transport mode position.

FIG. 6 shows the pickup device 15 having been moved directly above a receiving station 16. As shown, the device 15 has been moved to a position where the projecting ends of needles 24 are only a small fraction of an inch above the surface of the receiving station 16. With the part 14 so positioned (which may be to bring the part 14 into registry with a previously deposited part), the stripper cylinder 18 will be caused to be actuated to force the stripper plate away from the ends of the needles 24, thus effecting a stripping action as shown in FIG. 7. After deposition of the part, the stripper plate and needles will again be actuated to the position of FIG. 2 and returned to the initial pickup station.

Finally, FIG. 9 illustrates a typical needle configuration which has been found to be particularly satisfactory and useful. The needle illustrated is actually a conventional, commercial sewing machine needle having a groove 24*a* and transverse thread opening 24*b* therein. It will be seen that as typically manufactured, the sewing machine needle 24 has a concave surface 24*c* which diminishes the width of the needle at this point. Typically, the needles 24 will be extended from their holders sufficiently so that the fabric layers will be pierced sufficiently to have the needle point penetrate the layer somewhat beyond the needle hole 24*b*, thus permitting the fabric to close slightly in the area of concave surface 24*c*. A particular advantage seen in using ordinary sewing machine needles is that such needles are designed to penetrate most fabrics without disfiguring or tearing the fabric. Another advantage is that should a needle break or become worn, a ready and inexpensive supply of such needles is always readily at hand.

It will be understood that the foregoing description has been of a particular embodiment, and therefore merely representative. For example, although the needle assembly has been illustrated as having the needles descending vertically or parallel to a vertical axis through the frame, for certain materials, the needles may be slightly slanted outwardly to increase their relative holding capacity. Also, the device as shown may be operated somewhat differently than the sequence described above. For example, for certain materials, it may not be necessary to bring the plate 28 down against the work piece to clamp it against the loading platform prior to piercing with the needles. In such circumstances, it may be possible, for example, to merely actuate the needles to carry the plate 28 downwardly against stops 27 causing the piercing action to occur prior to bringing the plate 28 down against the work piece. Thereafter, stripping action will be effected as described. In order to understand fully the scope of the invention, attention should be directed to the claims.

I claim:

1. A device adapted to pick up and release a layer of sheet material from a loading platform comprising, a frame located in overlying relationship above said platform, a plurality of needles secured to said frame to project downwardly toward said layer from an undersurface of said frame, said needles being spaced apart lengthwise and widthwise to pierce said layer peripherally thereof, a single flat plate extending about and continuously extending between all of said needles horizontally beneath said frame, means for moving said plate toward said sheet material to press the material lying between all of said needles uniformly toward and against said platform, apertures defined by said plate for receiving said needles, means for moving said needles through said plate and through said sheet material, means for limiting movement of said needles through said plate and into said material, means for maintaining said plate and needles in a predetermined relative position while transporting said sheet material to an alternate location, and means for moving said plate upon reaching said alternate location away from said frame to withdraw said needles from said sheet material whereby said sheet material is stripped from said needles and is deposited at said alternate location.

2. The method of picking up and releasing a layer of sheet material from a plurality of layers of sheet material forming a stack location upon a loading platform comprising the steps of: first, uniformly and in an overall manner pressing the stack of sheet material down and against the loading platform throughout an area to be subsequently pierced by spaced apart needles; second, piercing said sheet material lengthwise and widthwise adjacent to the periphery thereof by a plurality of needles which move through said sheet material toward said loading platform; third, limiting the piercing movement of said needles to engage only a predetermined thickness of material; fourth, releasing the flattening pressure from said stack; fifth, lifting said needles and sheet material from said stack; sixth, moving said needles and sheet material to a location other than said loading platform and seventh, withdrawing said needles from said sheet material to effect disengagement from said sheet material and to deposit said sheet material at said other location.

* * * * *